US008657264B2

(12) United States Patent
Kin et al.

(10) Patent No.: US 8,657,264 B2
(45) Date of Patent: Feb. 25, 2014

(54) CARBURETOR CHOKE MECHANISM

(71) Applicant: Mikuni Corporation, Tokyo (JP)

(72) Inventors: Chirei Kin, Odawara (JP); Akihiro Sugizaki, Odawara (JP)

(73) Assignee: Mikuni Corporation, Odawara (JP)

( * ) Notice: Subject to any disclaimer, the term of this patent is extended or adjusted under 35 U.S.C. 154(b) by 0 days.

(21) Appl. No.: 13/658,771

(22) Filed: Oct. 23, 2012

(65) Prior Publication Data

US 2013/0106002 A1 May 2, 2013

(30) Foreign Application Priority Data

Oct. 26, 2011 (JP) ..... 2011-234605

(51) Int. Cl.
*F02M 1/10* (2006.01)

(52) U.S. Cl.
USPC ..... 261/39.1; 261/39.6

(58) Field of Classification Search
USPC ..... 261/39.1, 39.2, 39.3, 39.4, 39.6
See application file for complete search history.

(56) References Cited

U.S. PATENT DOCUMENTS

| | | | | | |
|---|---|---|---|---|---|
| 1,814,601 | A | * | 7/1931 | Johnson | 261/39.3 |
| 2,995,348 | A | * | 8/1961 | Eberhardt | 261/39.3 |
| 3,606,983 | A | * | 9/1971 | Mitchell | 261/39.3 |
| 3,685,809 | A | * | 8/1972 | Manning | 261/39.3 |
| 3,752,450 | A | * | 8/1973 | Charron et al. | 261/39.1 |
| 3,886,241 | A | * | 5/1975 | Schubeck | 261/39.3 |
| 3,898,967 | A | * | 8/1975 | Bennett et al. | 261/39.1 |
| 3,906,911 | A | * | 9/1975 | Nakada et al. | 261/39.1 |
| 3,980,065 | A | * | 9/1976 | Nomura et al. | 261/39.6 |
| 4,026,280 | A | * | 5/1977 | Iiyama et al. | 261/23.2 |
| 4,269,792 | A | * | 5/1981 | Winkley | 261/39.3 |
| 4,465,640 | A | * | 8/1984 | Dougherty | 261/39.3 |
| 5,915,355 | A | * | 6/1999 | Andreasson | 123/336 |
| 6,990,969 | B2 | * | 1/2006 | Roth et al. | 123/676 |
| 7,144,000 | B2 | * | 12/2006 | Roth et al. | 261/39.3 |
| 7,886,716 | B1 | * | 2/2011 | Arai et al. | 123/400 |
| 2006/0208371 | A1 | * | 9/2006 | Suzuki et al. | 261/39.1 |

FOREIGN PATENT DOCUMENTS

| | | | | | |
|---|---|---|---|---|---|
| JP | 53-118631 | A | * | 10/1978 | 261/39.6 |
| JP | 60-228749 | A | * | 11/1985 | 261/39.4 |
| JP | 4129244 | B | | 10/2005 | |

* cited by examiner

*Primary Examiner* — Richard L Chiesa
(74) *Attorney, Agent, or Firm* — Orion Consulting, Ltd.; Joseph P. Farrar, Esq.

(57) ABSTRACT

A carburetor choke mechanism including an actuator linearly expanded and contracted based on a temperature change; a connection lever which is connected to a rotation axis at one end, and rotates based on receiving a thrust of the actuator; a choke lever which is connected with the other end of the connection lever, and receives a rotary force; and a valve shaft where a choke valve is fixed to one end thereof, and a valve shaft lever which receives a transfer of a rotary force from the choke lever is provided on the other end thereof, wherein the choke lever has a bottomed cylindrical shape covering an outer circumference of the valve shaft lever, and the valve shaft lever penetrates a bottom thereof, and is provided rotatably, and a connection mechanism between the connection lever and the choke lever is provided inside a cylindrical outer periphery of the choke lever.

6 Claims, 6 Drawing Sheets

BACKGROUND ART

BACKGROUND ART

CARBURETOR CHOKE MECHANISM

BACKGROUND OF THE INVENTION

1. Field of the Invention

The present invention relates to a carburetor choke mechanism which controls a degree of opening of a choke valve automatically.

2. Related Background of the Invention

A choke mechanism is used in order to enhance an air-fuel ratio temporarily at the time of engine start-up. Although a choke valve has been opened and closed by manual operation heretofore, increasing recently has been an automatic choke type where the degree of opening of the choke valve provided in a carburetor has been made to be dependent on a change of an engine temperature for achieving stabilizing of a warming-up operation, and enhancing in fuel efficiency (for example, Patent Document 1).

FIG. 7 is a side view showing a conventional choke mechanism shown in Patent Document 1. In addition, FIG. 8 is a sectional view of FIG. 7, and FIG. 8A shows an A-A cross section, and FIG. 8B shows a B-B cross section.

The choke mechanism described in Patent Document 1 is designed to have a mechanism in which a valve shaft 31*a* of a choke valve 31 is arranged at a position which is offset to one side from a center line of an intake-air path 30*a*, and the choke valve 31 inclines against the center line of the intake-air path 30*a* so that a large side of the choke valve 31 rather than a small side thereof may be located at a downstream side of the intake-air path 30*a* in a fully closed state. A choke lever 33 is mounted in a form that it projects outside from a carburetor main body 30 of the valve shaft 31*a*, and this choke lever 33 is comprised of a bottomed cylindrical part 33*a* fitted to the valve shaft 31*a* in a rotatable state, and of a lever arm 33*b* protruded in a integrated form on an outer side of this bottomed cylindrical part 33*a*. In an inner side of the bottomed cylindrical part 33*a*, a pair of stopper protrusions 34 and 34' arranged at a certain interval in the circumferential direction are formed, and a valve shaft lever 35 has been fixed to the valve shaft 31*a* so that the valve shaft 31*a* may become rotatable only between these stopper protrusions 34 and 34'. Then, a valve shaft spring 36 to energize this valve shaft lever 35 so as to be abutted on one stopper protrusion 34 located at a closing side of the choke valve 31 is provided between the choke lever 33 and the valve shaft lever 35.

At a lower outer circumference of the choke lever 33, a pair of stopper walls 37 and 37' which are arranged at an interval in the circumferential direction are formed, and a stopper pin 38 arranged between these stopper walls 37 and 37' is protruded from the carburetor main body 30. Then, by one stopper wall 37 abutting on the stopper pin 38, a closing position C of the choke lever 33 at which the choke valve 31 is made to be fully closed is specified, and by the other stopper wall 37' abutting on the stopper pin 38, a opening position O of the choke lever 33 at which the choke valve 31 is made to be fully opened is specified.

Opening and closing of the choke valve 31 in the case of an automatic choke type is performed by using an actuator which is expanded and contracted depending on the change of the engine temperature. However, in the case of the choke mechanism like Patent Document 1, at the time of fully closing or small degree of opening of the choke valve 31, if an engine intake-air negative pressure exceeds a certain value, a difference between a rotation moment caused by the intake-air negative pressure which operates on the large side of the choke valve 31 and a rotation moment caused by the intake-air negative pressure which operates on the small side of the choke valve 31 overcomes a rotation moment caused by the valve shaft spring 36, and the degree of opening of the choke valve 31 may be increased. That is, the choke valve 31 is energized to a fully-closed side, and however, it has such a configuration as to be able to be opened without depending on an actuator when the intake-air negative pressure becomes large. Besides, the degree of opening thereof is limited by the valve shaft lever 35 being abutted on the other stopper protrusion 34'.

PRIOR ART DOCUMENT

Patent Document

Patent Document 1: Japanese Patent Publication No. 4129244

SUMMARY OF THE INVENTION

Here, in the choke mechanism described in Patent Document 1, since the lever arm 33*b* is located on the outer side of the bottomed cylindrical part 33*a*, a radius of rotation (arm length) for rotating the choke lever 33 inevitably becomes large, and it is necessary to enlarge a stroke of an actuator in connection with it. Consequently, a structure of the whole choke mechanism must be enlarged, and since the stroke is large, it takes time to open the choke valve 31, and it will also result in causing deterioration of fuel consumption.

Then, the present invention makes it an object to provide a carburetor choke mechanism which, while being an automatic choke type, is capable of making short an arm length of a choke lever which rotates a choke valve, making the whole choke mechanism compact, and making opening/closing time of the choke valve short with a simple configuration.

In order to achieve an above-mentioned object, the carburetor choke mechanism according to the present invention may comprise: an actuator which expands and contracts in a straight manner based on a temperature change; a connection lever which is connected to a rotation axis at one end, and which rotates based on receiving a thrust of the actuator; a choke lever which is connected with the other end of the connection lever, and receives a rotatory force; and a valve shaft on which a choke valve is fixed, and which rotates based on receiving a rotatory force from the choke lever, wherein the choke lever has a bottomed cylindrical shape covering an outer circumference of the valve shaft, and the valve shaft penetrates a bottom thereof, and the choke lever is provided rotatably centering around the valve shaft, and at least a part of connection mechanism between the connection lever and the choke lever is provided inside a cylindrical outer periphery of the choke lever.

In addition, the carburetor choke mechanism may be configured so that the valve shaft has a valve shaft lever at one end side, and a rotatory force of the choke lever is transferred to the valve shaft by the valve shaft lever, and/or so that provided is a cap which covers a cylindrical opening of the choke lever, and which rotates together with the choke lever, and a connection mechanism between the connection lever and the choke lever has been provided on an upper surface of the cap; and/or so that the connection mechanism is one which is constituted by inserting a pin in a groove, and either the groove or the pin is provided on the cap, and the other of the groove or the pin is provided in the connection lever.

According to the carburetor choke mechanism of the present invention, since the whole structure can be made compact, and the degree of opening of the choke valve can be controlled by a small stroke, an effect that it becomes possible to drive a choke valve after starting an engine more effectively and in a short time can be achieved.

DESCRIPTION OF THE PREFERRED EMBODIMENTS

Hereinafter, embodiments of the present invention will be described with reference to accompanying drawings.

Figure 1A:
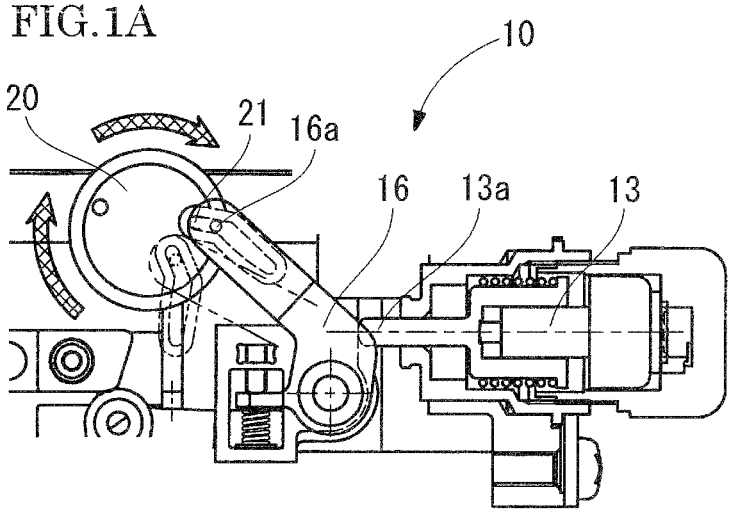
FIG. 1A is a plan view showing a carburetor choke mechanism according to the present invention.
Figure 1B:
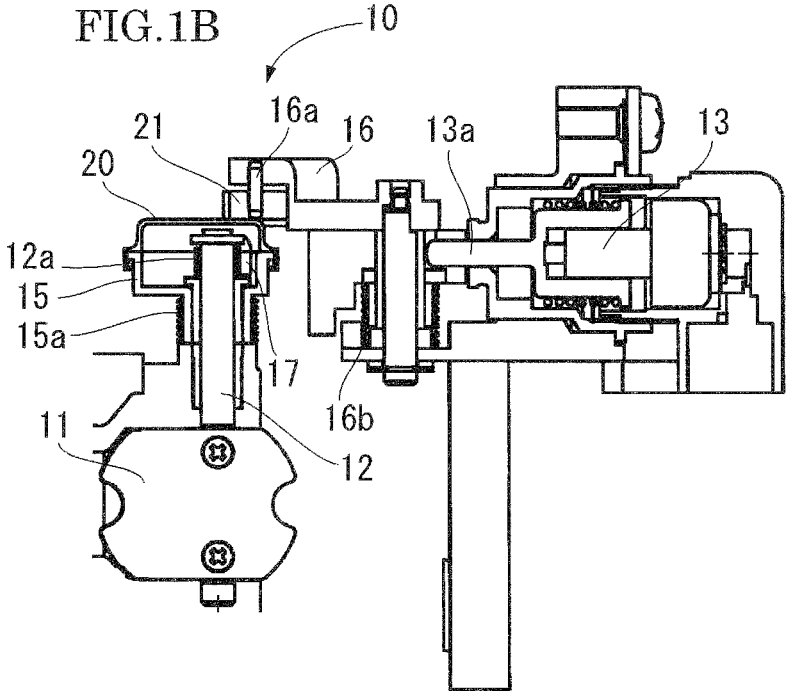
FIG. 1B is a front view showing a carburetor choke mechanism according to the present invention.

FIG. 1 is a figure showing a carburetor choke mechanism according to the present invention, and FIG. 1A is a plan view, and FIG. 1B is a front view.

A driving source of this choke mechanism 10 is an electric type heat source actuator 13. This electric type heat source actuator 13 is provided inside with a heater element which is not shown, and is configured so that internal wax may be distended when a temperature of this heater element rises, and thereby, a tip part 13*a* may be moved forward. After that, if electric conduction to the heater element is stopped and a temperature of the element descends, the tip part 13*a* will return to the original position.

The tip part 13*a* of the electric type heat source actuator 13 abuts on a connection lever 16, and transfers a motive power thereto. The connection lever 16 is configured so that one end thereof is connected to a rotation axis, and the other end is connected to a choke lever 15. Since the connection lever 16 is provided with a connection lever spring 16*b*, and is energized toward the tip part 13*a* of the electric type heat source actuator 13, the connection lever 16 is in a state of receiving a thrust always from the electric type heat source actuator 13. Then, the connection lever 16 carries out rotational movement based on the thrust from the electric type heat source actuator 13.

As for the connection lever 16 and choke lever 15, a connection pin 16*a* is provided in the vicinity of an edge part of the connection lever 16, and by inserting the connection pin 16*a* in a connection groove 21 provided on an upper surface of a cap 20 of the choke lever 15, the connection lever 16 and choke lever 15 are made to be connected. Besides, conversely, the configuration may be such that the connection pin 16*a* is provided on an upper surface of the cap 20, and the connection groove 21 is provided in the connection lever 16. In the above configuration, a connection mechanism is configured by the connection groove 21 and the connection lever 16. Then, as for this connection mechanism, at least a part of the configuration exists in an inner side of the outer periphery of the cylindrical choke lever 15.

The cap 20 is, originally, a dust prevention cap which has been attached so that dust and water may not enter into the cylindrical choke lever 15. In the case of having used it only for a usage of a dust prevention cap, what is necessary has been that the dust prevention cap has been just fitted in the choke lever 15 rotatably because of having covered only an opening of the choke lever 15. However, since the cap 20 used in the present invention must transfer a power from the connection lever 16 to the choke lever 15, the cap 20 and the choke lever 15 must be fixed mutually, by means of a pin or the like, so as not to rotate. A shape of the cap 20 and choke lever 15 may be configured so as to make the cap 20 and choke lever 15 not to be rotated mutually.

When connected by such connection mechanism as this, a movement of the tip 13*a* of the actuator will make the connection lever 16 rotate, and the connection pin 16*a* will transfer a rotatory force to the choke lever 15 while moving inside the connection groove 21. Besides, since there are various methods other than this as a connection method of the connection lever 16 and choke lever 15, variations thereof will be described later.

The choke lever 15 has a bottomed cylindrical shape, and has a cylindrical shape in the illustrated example, and however, the shape is not limited to the cylindrical shape. The shape may be a rectangular pipe shape or an ellipse shape. As for this choke lever 15, a valve shaft 12 has penetrated a bottom part thereof. That is, the choke lever 15 has been fitted to the valve shaft 12 rotatably. In addition, at one end of the valve shaft 12, a choke valve 11 is fixed, and at the other end of the valve shaft 12, a valve shaft lever 17 is provided. Then, the structure is configured so that a rotatory force can be transferred to the valve shaft 12 from the choke lever 15 through the valve shaft lever 17.

In an inner side of the choke lever 15, stoppers have been provided in the same way as a conventional way, and the valve shaft lever 17 is limited so that the choke valve 11 can rotate only between a fully opened position and a fully closed position by means of the stoppers. In addition, a valve shaft spring 12*a* which energizes the valve shaft 12 in a full closing direction of the choke valve 11 is provided between the choke lever 15 and the valve shaft lever 17.

Furthermore, other stoppers are provided at a lower outer circumference of the choke lever 15, which limits the choke lever 15 so as to be able to rotate the choke valve 11 only between the fully closed position and fully opened position thereof. Besides, the choke lever 15 is energized in the full closing direction of the choke valve 11 by the choke lever spring 15*a*.

In addition, in the same way as a conventional example, at the time of fully closing or small degree of opening of the choke valve 11, if an engine intake-air negative pressure exceeds a certain value, a difference between a rotation moment caused by the intake-air negative pressure which operates on the large side of the choke valve 11 and a rotation moment caused by the intake-air negative pressure which operates on the small side of the choke valve 11 overcomes a rotation moment caused by the valve shaft spring 12*a*, and the degree of opening of the choke valve 11 can be made to be increased. Then, the increase in the degree of opening is restricted by the valve shaft lever 17 abutting on the stopper.

Figure 2A:
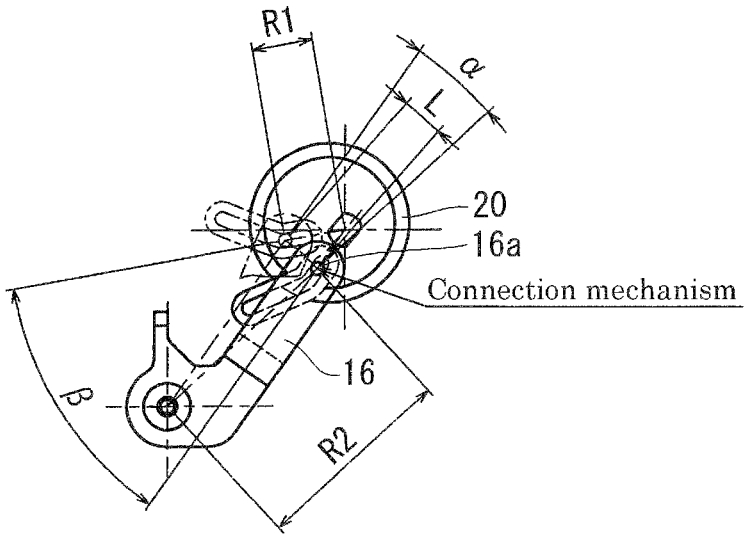
FIG. 2A is a plan view of a connection portion describing a relation between a choke lever and a connection lever.
Figure 2B:
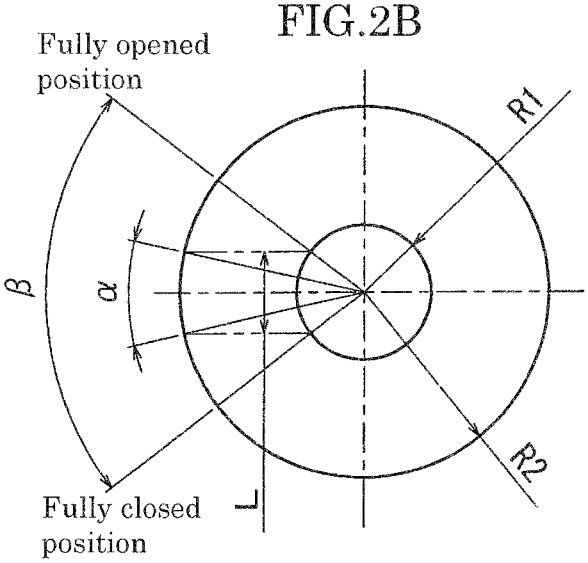
FIG. 2B is a schematic diagram describing a relation between a choke lever and a connection lever.

FIG. 2 is a figure describing a relation between the choke lever and the connection lever, and FIG. 2A is a plan view of a connection portion, and FIG. 2B is a schematic diagram for description. In addition, FIG. 3 is a sectional view describing an arm length.

A rotation angle required for making the choke valve 11 moved from a fully closed position to a fully opened position is assumed as β, and a distance from an axial center of the valve shaft 12 to an axial center of the connection pin 16*a* is assumed as R1, and a distance from a rotation axis of the connection lever 16 to the connection pin 16*a* is assumed as R2. Consequently, a stroke L of the connection pin 16*a* is determined by R1 and β. Here, it is the electric type heat source actuator 13 that moves the connection lever 16, and a rotation angle α is determined based on a specified stroke amount of the electric type heat source actuator 13, and spatial relationship between a rotation axis of the connection lever 16 and the electric type heat source actuator 13. Therefore, if the distance R1 from the axial center of the valve shaft 12 to the axial center of the connection pin 16*a* is made to be short, the stroke L of the connection pin 16*a* can be made to be short in the same way, and the distance R2 from the rotation axis of the connection lever 16 to the connection pin 16*a* can also be made to be short thereby. Thereby, the connection mechanism can be constituted compactly on the whole.

Figure 3:
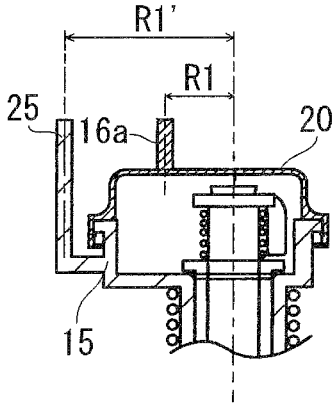
FIG. 3 is a sectional view describing an arm length.

As for a conventional connection mechanism, as shown in FIG. 3, since a projection 25 or the like has been provided at an outer side of a cylinder part of the choke lever 15, an arm length becomes R1', and as a matter of course, it is longer than the arm length R1 of the present invention. Therefore, the connection mechanism will also have been made to be large on the whole. In the present invention, since adopted has been a configuration such that the connection pin 16 may come on an upper surface of the cap 20 in order to make R1 small, the distance R1 from the axial center of the valve shaft 12 to the axial center of the connection pin 16*a* can be made to be short.

The configuration like this enables the whole choke mechanism 10 to be compact. In addition, it is possible that the cap 20 conventionally used for dust prevention is utilized effectively, and the connection mechanism is provided on the cap 20.

Figure 4A:
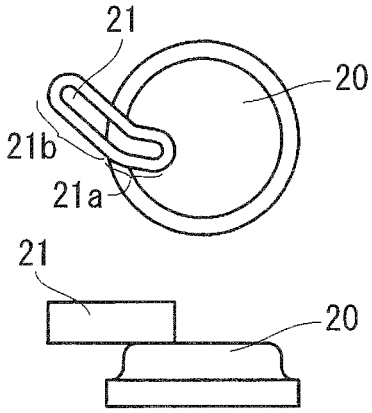
FIG. 4A is a figure in which a connection mechanism is provided on a cap used in the present invention, and shows an example of a connection groove.
Figure 4B:
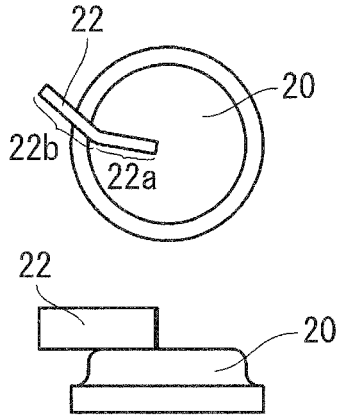
FIG. 4B is a figure in which a connection mechanism is provided on a cap used in the present invention, and shows an example of a connection plate.
Figure 5A:
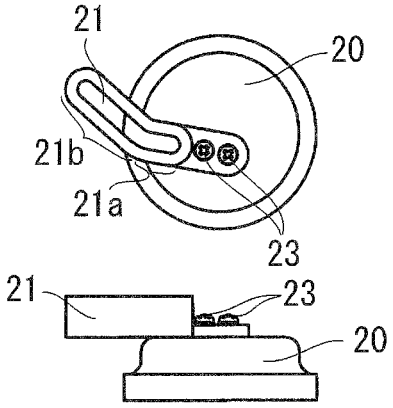
FIG. 5A is a figure in which a connection groove is attached, as a connection mechanism, to a cap used in the present invention.
Figure 5B:
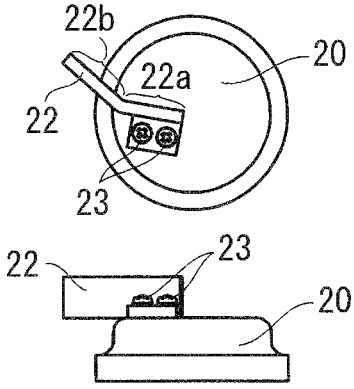
FIG. 5B is a figure in which a connection plate is attached, as a connection mechanism, to a cap used in the present invention.

Then, a variation of the connection mechanism will be investigated. FIG. 4 is a figure in which a cap used for the present invention is provided with a connection mechanism, and FIG. 4A shows an example in which a connection groove is provided, and FIG. 4B shows an example in which a connection plate is provided. In addition, FIG. 5 is a figure in which a cap used for the present invention is provided with a connection mechanism, and FIG. 5A shows an example in which a connection groove is attached, and FIG. 5B shows an example in which a connection plate is attached. Here, although an example in which the connection groove 21 and the connection plate 22 are provided in a cap 20 side is shown, the connection pin 16*a* may be provided in the cap 20 side, and the connection groove 21 and the connection plate 22 may be provided in the connection lever 16 side.

In the case of a structure using the connection groove 21, since the connection is carried out with the connection pin 16*a* inserted in the groove, there is no possibility that the connection mechanism will be dislocated. However, even without doing so far, because of energizing separately by means of a spring or the like, it is considered that the case where the connection mechanism is dislocated will be little even in the case of the connection plate 22 as shown in FIG. 43. In addition, FIG. 4A and FIG. 4B show the case where the cap 20 and the connection groove 21 or the connection plate 22 are manufactured as a unit, and however, these may be attached on an upper surface of the cap 20 using screws 23 or the like as shown in FIG. 5A and FIG. 5B. As a matter of course, these may be attached with an adhesive.

In addition, the connection groove 21 or the connection plate 22 has a shape in which there exists a turnoff point and two straight lines seem to be connected. In the case of only opening and closing of the choke valve 11, only one straight line part 21*a* or 22*a* is sufficient, and however, a reason for having provided straight line part 21*b* or 22*b* in addition to that is because adjusting is carried out so that a some oversized stroke rather than a required stroke may be generated since it is difficult to make a stroke of the electric type heat source actuator 13 constant. That is, if a stroke of the electric type heat source actuator 13 becomes larger than a prescribed amount, the connection lever 16 also is going to rotate more greatly than the required amount of rotation, and therefore, additional straight line part 21*b* or 22*b* is provided so that the connection pin 16*a* may escape then. Therefore, the additional straight line part 21*b* or 22*b* is configured as an angle such that the choke lever 15 does not rotate even in the case of the connection pin 16*a* passing.

Besides, at least a part of the straight line part 21*a* or 22*a* where the connection pin 16*a* conducts from fully closing to fully opening of the choke valve 11 may just be inside an outer periphery of the choke lever 15, and a part may project in the outer side of the outer periphery. However, if all the straight line parts 21*a* and 22*a* exist inside the outer periphery of the choke lever 15, the stroke of the actuator 13 can be made smaller, and the connection mechanism can be made more compact.

Examples shown so far have had the connection groove 21 or the like provided on an upper surface of the cap 20 covering the choke lever 15, and however, a case where the cap 20 is not used is also considered. FIG. 6 shows an example of a connection mechanism which does not use a cap.

Figure 6A:
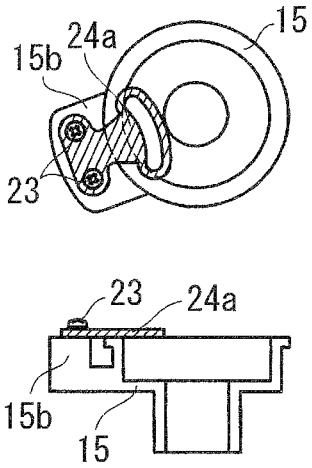
FIGS. 6A, 6B, and 6C show examples of a connection mechanism which does not use a cap.
Figure 6B:
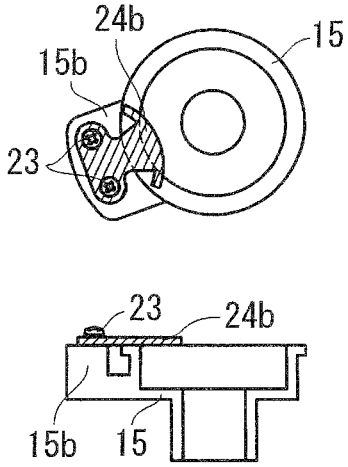

FIG. 6A and FIG. 6B show a case where there is no cap 20. At this time, a projection 15*b* is made to be provided on an outer side of the choke lever 15, and a connection groove 24*a* or a connection plate 24*b* may be just attached thereto with screws 23 or the like. Shapes (for example, the direction of a groove, etc.) of the connection groove 24*a* and the connection plate 24*b* are not limited to shown shapes, and however, since there is a purpose of making the arm length (R1) short, the connection position should be made to exist inside the cylindrical shape of the choke lever 15.

Figure 6C:
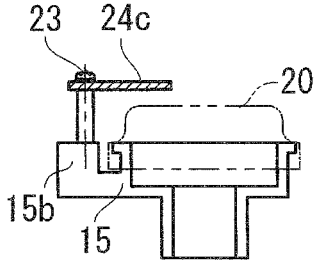
Figure 7:
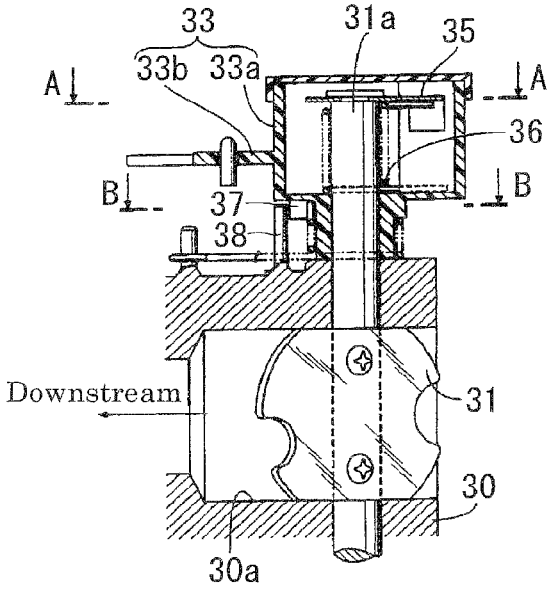
FIG. 7 is a side view showing a conventional choke mechanism.
Figure 8A:
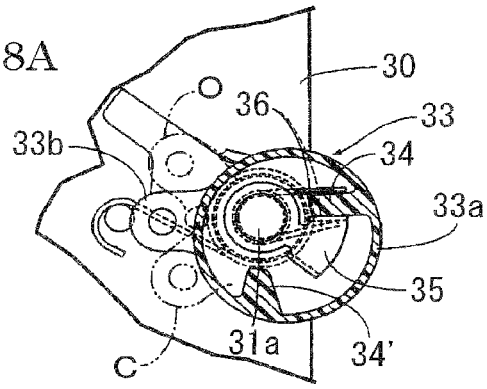
FIG. 8A is an A-A sectional view of FIG. 7.
Figure 8B:
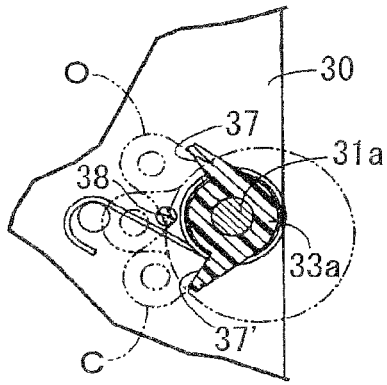
FIG. 8B is a B-B sectional view of FIG. 7.

In addition, in FIG. 6C, the cap 20 is used, and however, a case where the cap 20 is not used in the connection mechanism is shown. The projection 15*b* having a height exceeding the cap 20 is made to be provided on an outer side of the choke lever 15 also here, and a connection plate 24*c* is attached on a crown of the projection 15*b* with screws 23 or the like. The shape of the connection plate 24*c* is not limited in particular, and may be the same shape as the connection groove 24*a* or the connection plate 24*b*, and may be the same shape as the connection groove 21 shown in FIG. 1.

As mentioned above, by providing at least a part of the connection mechanism over the choke lever 15, or on the upper surface of the cap 20, the stroke of the electric type heat source actuator 13 results in being short, and therefore, it is possible to make the choke mechanism compact. In addition, if the stroke is short, a driving period also becomes short, and therefore, the carburetor choke mechanism 10 which optimizes an air-fuel ratio, and leads also to enhancing fuel consumption has been achieved. In addition, such carburetor choke mechanism as this has general-purpose properties, and can be applied to many models.

What is claimed is:

1. A carburetor choke mechanism comprising:

an actuator which expands and contracts in a straight manner based on a temperature change;

a connection lever which rotates based on receiving a thrust of the actuator;

a choke lever which is connected with the other end of the connection lever, and receives a rotary force; and a valve shaft on which a choke valve is fixed, and which rotates based on receiving a rotary force from the choke lever, wherein the choke lever has a bottomed cylindrical shape covering an outer circumference of the valve shaft lever, and the valve shaft lever penetrates a bottom thereof, and the choke lever is provided rotatably centering around the valve shaft; and at least a part of a connection mechanism between the connection lever and the choke lever is provided inside a cylindrical outer periphery of the choke lever.

2. The carburetor choke mechanism according to claim 1, wherein the valve shaft has a valve shaft lever at one end side, and a rotary force of the choke lever is transferred to the valve shaft by the valve shaft lever.

3. The carburetor choke mechanism according to claim 1, wherein a cap which covers a cylindrical opening of the choke lever, and which rotates together with the choke lever is provided, and the connection mechanism between the connection lever and the choke lever has been provided on an upper surface of the cap.

4. The carburetor choke mechanism according to claim 2, wherein a cap which covers a cylindrical opening of the choke lever, and which rotates together with the choke lever is provided, and the connection mechanism between the connection lever and the choke lever has been provided on an upper surface of the cap.

5. The carburetor choke mechanism according to claim 3, wherein the connection mechanism is one which is constituted by inserting a pin in a groove, and either the groove or the pin is provided on the cap, and the other of the groove or the pin is provided in the connection lever.

6. The carburetor choke mechanism according to claim 4, wherein the connection mechanism is one which is constituted by inserting a pin in a groove, and either the groove or the pin is provided on the cap, and the other of the groove or the pin is provided in the connection lever.

* * * * *